US006325231B1

(12) United States Patent
Ketting et al.

(10) Patent No.: US 6,325,231 B1
(45) Date of Patent: Dec. 4, 2001

(54) CONTAINER FOR FOODSTUFFS

(75) Inventors: Willem-Hendrik Ketting, Rotterdam (NL); Sean Anthony Richardson, Rome (IT)

(73) Assignee: Unilever Patent Holdings B.V., Vlaardingen (NL)

( * ) Notice: Subject to any disclaimer, the term of this patent is extended or adjusted under 35 U.S.C. 154(b) by 0 days.

(21) Appl. No.: 09/554,766

(22) PCT Filed: Nov. 11, 1998

(86) PCT No.: PCT/EP98/07325

§ 371 Date: Jul. 10, 2000

§ 102(e) Date: Jul. 10, 2000

(87) PCT Pub. No.: WO99/25622

PCT Pub. Date: May 27, 1999

(30) Foreign Application Priority Data

Nov. 19, 1997 (DE) ..... 197 51 321
Nov. 19, 1997 (DE) ..... 297 20 431 U

(51) Int. Cl.[7] ..... B65D 47/08

(52) U.S. Cl. ..... 220/254; 220/259; 220/831; 220/847; 222/556

(58) Field of Search ..... 220/4.25, 252, 220/254, 259, 270, 831–832, 833–835, 837–839, 847; 222/556

(56) References Cited

U.S. PATENT DOCUMENTS 4,265,367 * 5/1981 Vogt ..... 220/270
4,756,442 * 7/1988 Halm et al. ..... 220/254
5,273,177 12/1993 Campbell .
5,301,827 * 4/1994 Valyi ..... 220/259
5,503,289 4/1996 Fox .
5,673,811 * 10/1997 Dickinson et al. ..... 220/837
5,839,601 * 11/1998 Van Melle ..... 220/254

FOREIGN PATENT DOCUMENTS

3530373 * 2/1987 (DE) .
569747 * 11/1993 (EP) .
3-187846 * 8/1991 (JP) .
WO95/35245 A 12/1995 (WO) .

OTHER PUBLICATIONS

Patent Abstract of Japan, vol. 098, No.. 003, Feb. 27, 1998 & JP 09 290849 A (Yoshino Kogyosho Co. see abstract.

* cited by examiner

*Primary Examiner*—Nathan J. Newhouse
(74) *Attorney, Agent, or Firm*—Pillsbury Winthrop LLP

(57) ABSTRACT

The invention provides a container (2) with a container shroud (1) which has a base (4) and a top (3) and at least the top (3) is made of plastic and has a reclosable discharge aperture (23), with the top (3) having a lower circumferential edge (26) to connect the top (3) with the container shroud (1), and the discharge aperture (23) being covered by a cap (24) which is connected to the top (3) by film hinge (25) located in the vicinity of the highest point on the top (3) characterised in that the top (3) is substantially convex in form and the cap (24) is substantially concave in form and wherein the cap when in it's open form can be laid against the top (3) and in this state the cap (24) is largely congruent with the surface of the top (3). The container (2) has particular application in the packaging of foodstuffs.

11 Claims, 3 Drawing Sheets

CONTAINER FOR FOODSTUFFS

The present invention relates to a container for foodstuffs having a container shroud and a base and a top, whereby, at least the top is made of plastic and has a reclosable discharge aperture.

Such containers are known in practice in as much as they are manufactured from plastic as a single piece or do not have a totally satisfactory, or any, discharge aperture for the discharging of food products from the containers.

For example U.S. Pat. No. 4,213,537 discloses a plastic cover for a disposable paper receptacle, but the cover does not have a reclosable discharge aperture.

U.S. Pat. No. 5,743,427 discloses a lid of a container with a discharge aperture in the lid to allow the consumption of a drink through the lid but the discharge aperture area is designed only for fluid foodstuffs.

U.S. Pat. No. 4,298,146, U.S. Pat. No. 4,310,105 and U.S. Pat. No. 4,334,639 disclose a cap for a container where the cap lid may be laid away from the cap when it is in an open state.

However, none of the above prior art documents disclose a container having a top with a reclosable discharge aperture suitable for the easy dispensing of a non-liquid foodstuff.

The invention is directed towards the problem of fitting a top of the aforementioned type with a container shroud manufactured separately to provide the container whilst also providing effective and consumer-acceptable discharging of the container's foodstuff contents, particularly, non-liquid foodstuffs.

These problems have been addressed by designing the top in a substantially convex form with a circumferential lower edge to connect the top with the container shroud thereby allowing the manufacture of the container shroud and the top separately and subsequently connecting them to each other and with the top having a discharge aperture and a cap therefore in a substantially concave form.

Accordingly, a container with a container shroud which has a base and a top and at least the top is made of plastic and has a reclosable discharge aperture, with the top having a lower circumferential edge to connect the top with the container shroud, and the discharge aperture being covered by a cap which is connected to the top by a film hinge located in the vicinity of the highest point on the top characterised in that the top is substantially convex in form and the cap is substantially concave in form and wherein the cap when in its' open form can be laid against the top and in this state the cap is largely congruent with the surface of the top is provided according to the present invention.

The container shroud defines the sides of an internal cavity of the container with a top and base defining the top and bottom part respectively of the internal cavity.

By substantially convex is meant a shape that has all the features of a convex shape and overall convex outline, but, wherein the sides of the convex shape may be in parts more angular than the overall convex shape appears.

By substantially concave is meant a shape that has all the features of a concave shape and an overall concave outline, but, wherein the sides of the concave shape may be in parts more angular than the overall concave shape appears.

The container is for foodstuffs and, in particular, frozen foods such as frozen water ices and frozen confections and the like. However, any foodstuff that it is desirable to dispense easily from a re-closable container may be packaged in it.

The discharge aperture is covered by a cap which is connected to the top by a film hinge. The cap is captively connected to the top by the film hinge making the opening and closure of the discharge aperture easy to accomplish. The film hinge is located in the vicinity of the highest point of the top and the cap can be laid against the top when the cap is in its' fully open state.

By "highest point" is meant that part of the top which extends further away from the base of the container, generally in a perpendicular direction, than do other parts of the top.

The cap is substantially concave in form and is largely congruent with the convex surface of the top when the cap is in its fully open state and laid against the top.

It is especially preferred that the container shroud is wound from a flat blank, particularly a card blank. In a particular aspect of the present invention a container having a plastic top and a card, paper or other similar non-plastic material container shroud is provided.

A further aspect of the invention lies in moulding the cap onto the top by a circumferential perforation interrupted by the film hinge. This has the advantage of allowing a hygienic and tamper-evident seal to be provided to the cap.

A further highly-advantageous aspect of the invention is that the container shroud is designed as a cone opening, or expanding, downwards (ie in the shape of a cone) so that the circumference of the container at the part connecting with the top is smaller than the circumference of the container at the part connecting with the base.

A further advantageous development of the invention is that the base is generally flat, or level, and the edge of the base is connected to the lower edge of the container shroud. The advantage of this arrangement is enhanced stability for the container.

It is also highly advantageous if, in accordance with the further aspect of the invention, the base has a central web drawn inwards. This further improves the stability of the container and also facilitates its' suitability for handling.

It is also highly advantageous if the side of the base facing the internal cavity of the container is capable of accepting a seal. Simple sealing of the base on to a suitably moulded edge of the container shroud is thus possible.

In a further aspect of an invention it is also favourable to make the base as a deep drawn card disk capable of accepting a seal on its' inside, particularly, by coating it with polyethylene. This allows a variety of water-based products to be packaged in the container without affecting the integrity thereof, for example, a frozen water based product.

A further advantageous aspect of the invention is that the cap is formed with a pull tab, or similar part, moulded onto it and the top has a connection complimentary to the pull tab so that it can act as a snap connection for the pull tab, or similar part, and wherein the pull tab engages with the snap connection when the cap is in its' fully open state and against the top.

This provides the advantage of being able to effectively retain the cap away from the discharge aperture to allow effective and easy discharge of the container's contents.

The dimensions of the container will be determined according to the type of foodstuff being placed inside the container and the portion size thereof to be packaged in the container. Preferably the container is of sufficient dimensions to hold a single serving of a foodstuff such as frozen confection or water ice.

The invention is further described with reference to the embodiment shown in the drawings.

Figure 1:
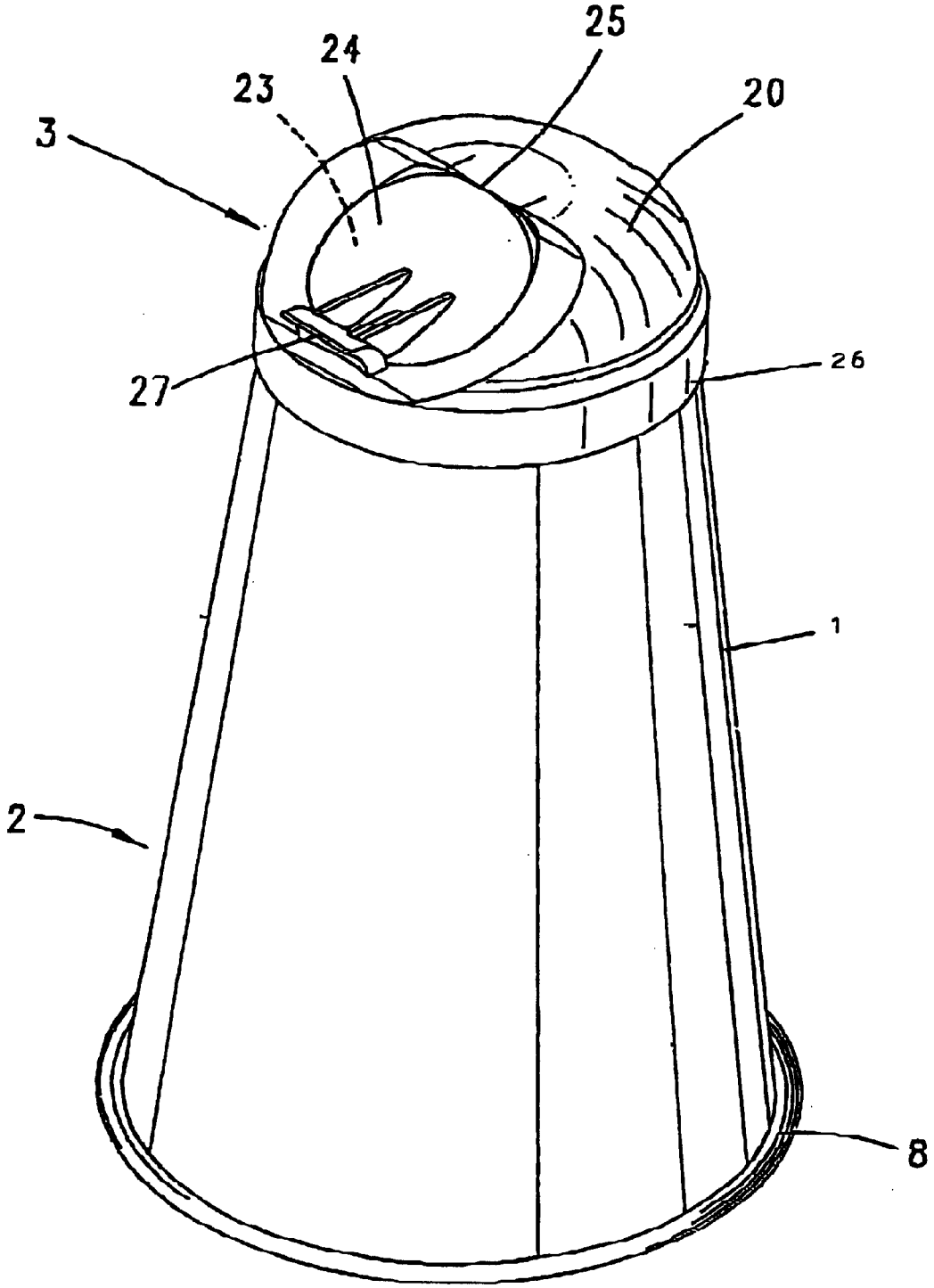
FIG. 1 is a diagrammatic representation of a container as according to the invention with a container shroud and a top at the opposite end of the container shroud to the base.
Figure 2:
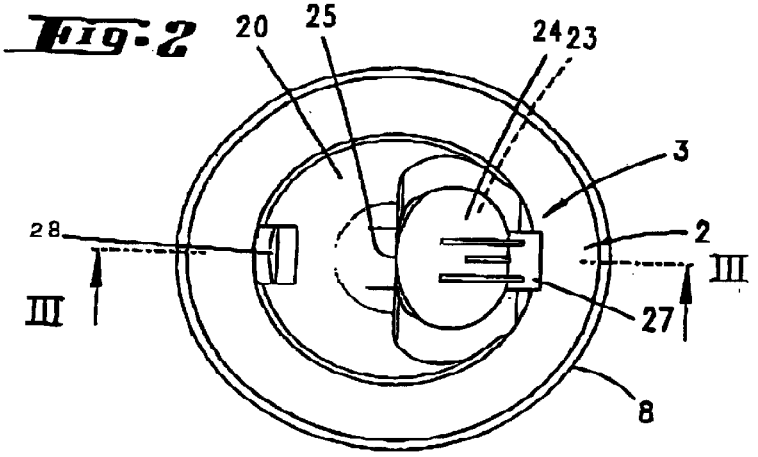
FIG. 2 is a horizontal projection of the top with the adjacent container shroud.
Figure 3:
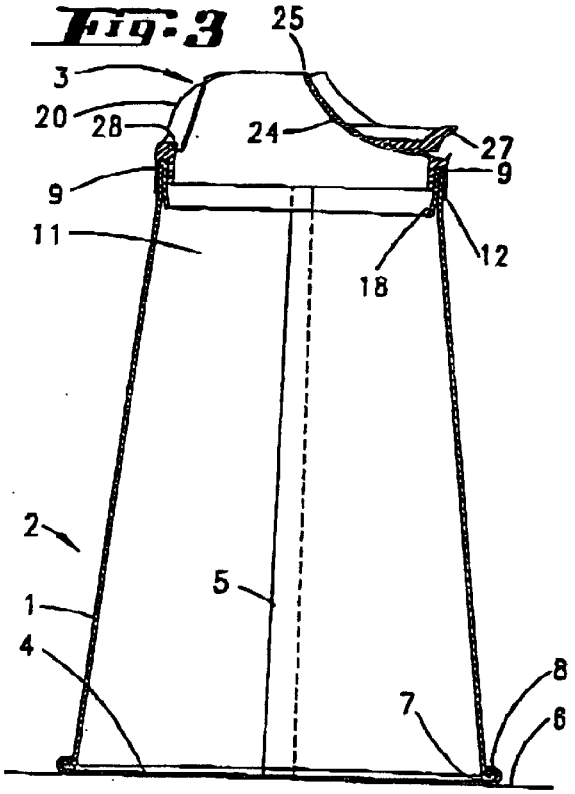
FIG. 3 is a vertical section through the container.
Figure 4:
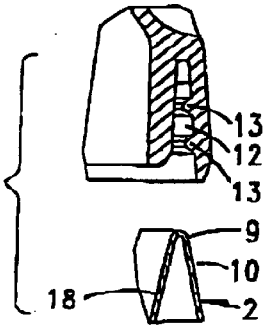
FIG. 4 is an enlarged section through the edge of the top and the edge of the container shroud which engages with it.
Figure 5:
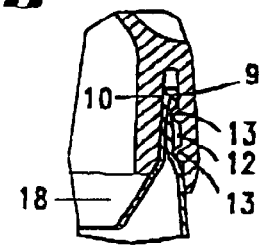
FIG. 5 is a further diagrammatic representation of both the parts shown in FIG. 4 in their assembled state.
Figure 6:
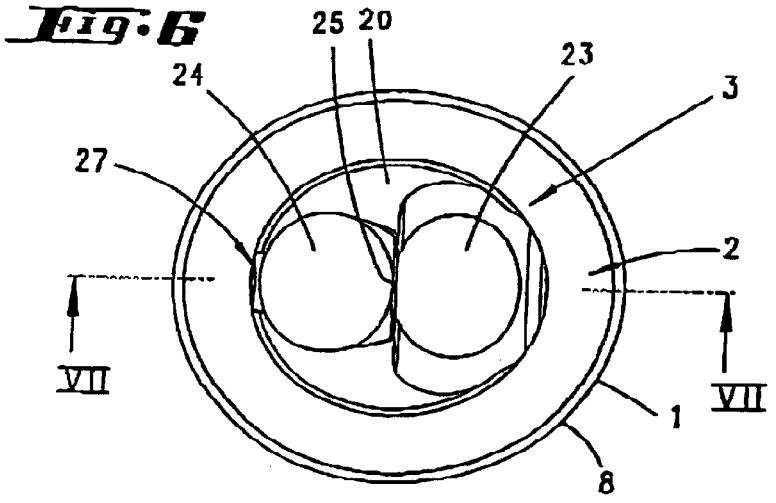
FIG. 6 is a horizontal projection of the top shown in FIG. 2 but with a sealing cap which is open.
Figure 7:
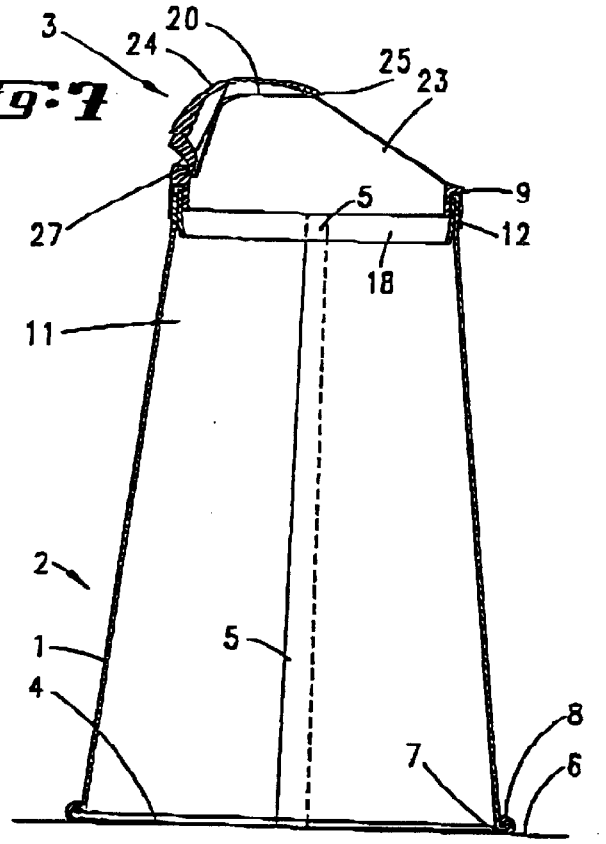
FIG. 7 is a vertical section through the container with an open cap as shown in FIG. 6.

The drawings show a container 2 fitted with a container shroud 1 and having a lower circumferential edge (26) in which the container shroud is wound from a flat card blank and sealed by a longitudinal seam 5. The container shroud may be made of plastic, whereby both winding from a piece of film and deep drawing are possible. A top 3 made of plastic is located on the upper surface of the container and a base 4 on its' underside. In the embodiment shown, this base, which is not applied until the container has been filled, is flat, so that it may be placed smoothly on a surface 6. The container shroud 1 has a crimped edge 7 at its lower end, to which the base 4 is attached. There are various ways of accomplishing this. In the drawings the edge of the base also has a crimping flange 8, both the crimped edge 7 and the crimping flange 8 being made together. The edge of the base 4 may, however, also be flat and sealed to the underside of crimping edge 7. Moreover, the central web of the base may be drawn inwards, whereby it is possible for it to be made of both plastic and card. When the base is made of card, it is practical to coat the inside with a sealable plastic layer, polythene being particularly suitable for this purpose, as this also provides a positive seal against the contents on the surface of the base.

The upper edge 9 of container shroud 1 is folded inwards, forming a double edge 10, the inner web 18 of which protrudes into the internal cavity of the container 2. The top 3 has a circumferential groove 12 open on the underside into which the double edge 10 is pushed. Circumferential ribs 13 protrude into this groove 12 holding the intruding double edge 10 firmly. This creates a wholly satisfactory connection during use, but one which can be separated easily when the container is completely empty, in order to separate the materials. Instead of a double edge it is also possible to make the edge with a single thickness of material, which is solely dependent on the thickness of the material used for container shroud 1.

The top 3 has a discharge aperture 23, sealed by a cap 24. Said cap 24 is articulated to the top 3 by a film hinge 25 and connected to the top by a perforation around its' entire circumference in its' original state. When opening for the first time pressure on the cap will separate the connection to the top 3 (perforation) and the cap 24 can be swung outwards on film hinge 25. The top 3 has an overall convex shape whilst cap 24 is arched inwards, concavely. Cap 24 can thus lie against the external surface of the top 3 when fully open, thereby permitting full opening of the discharge aperture 23. An additional snap connection 28 may also be provided which will hold the cap in its' open position against the top 3. A pull tab 27, which will engage in the snap connection 28, is moulded on to the cap 24 at the edge opposite the film hinge 25 to facilitate handling.

Further modifications of the container within the ambit of the present invention will be arrived at by the skilled person.

What is claimed is:

1. A container (2) with a container shroud (1) which has a base (4) and a top (3) and at least the top (3) is made of plastic and has a reclosable discharge aperture (23), with the top (3) having a lower circumferential edge (26) to connect the top (3) with the container shroud (1), and the discharge aperture (23) being covered by a cap (24) which is connected to the top (3) by a film hinge (25) located in the vicinity of the highest point on the top (3) characterised in that the top (3) is substantially convex in form and the cap (24) is substantially concave in form and wherein the cap (24) when in its' open form can be laid against the top (3) and in this state the cap (24) is largely congruent with the surface of the top (3).

2. A container according to claim 1 wherein the container shroud (1) is wound from a flat blank.

3. A container according to claim 2 wherein the flat blank is a card blank.

4. A container according to any one of the claims 1 to 3 wherein the cap (24) is moulded to the top (3) by a circumferential portion interrupted by the film hinge (25).

5. A container according to claim 1 wherein the container shroud (1) expands downwards in the form of a cone.

6. A container according to claim 1 wherein the base (4) is generally flat and the edge of the base (4) is connected to the lower edge of the container shroud (1).

7. A container according to claim 1 wherein the base (4) has an inner web drawn inwards.

8. A container according to claim 1 wherein the side of the base (4) facing the internal cavity (11) of the container (2) is capable of accepting a seal.

9. A container according to claim 1 wherein the base (4) is made as a deep-drawn card disc capable of accepting a seal on its' inside.

10. A container according to claim 9 wherein the seal is formed by coating with polythene.

11. A container according to claim 1 wherein the cap (24) has a pull tab (27) moulded onto it and the top (3) has a snap connection (28) wherein the pull tab (27) engages with the snap connection (28) when the cap (24) is in its' fully open state and against the top (3).

* * * * *